United States Patent [19]

Jaeger

[11] 4,111,484

[45] Sep. 5, 1978

[54] DENTAL CHAIR HEADREST LOCKING DEVICE

[75] Inventor: Robert Charles Jaeger, Howell, N.J.

[73] Assignee: Pennwalt Corporation, Philadelphia, Pa.

[21] Appl. No.: 818,638

[22] Filed: Jul. 25, 1977

[51] Int. Cl.[2] ..... A47C 1/10

[52] U.S. Cl. ..... 297/410; 248/414

[58] Field of Search ..... 248/161, 410, 414; 297/353, 410

[56] References Cited

U.S. PATENT DOCUMENTS

| | | | |
|---|---|---|---|
| 2,827,110 | 3/1958 | Rising | 297/410 X |
| 3,454,303 | 7/1969 | Dangauthier | 297/410 X |
| 3,635,527 | 1/1972 | Weber | 297/410 |
| 3,642,321 | 2/1972 | Schwarz | 297/410 |
| 3,698,765 | 10/1972 | Olsen | 297/410 X |

*Primary Examiner*—James C. Mitchell

[57] ABSTRACT

A headrest mounted above a dental chair backrest can readily be positioned by means of a headrest bar engaging a locking device affixed to the chair backrest. The locking device comprises a pair of resilient rubber surfaces or other high friction material surfaces which grip or contact the headrest bar to positively lock the headrest in position. By merely pushing the headrest to a more vertical position, the headrest bar is caused to lose contact with the gripping surfaces. A spring-loaded block is selectively disposed through each of the high friction surfaces to urge the bar in stronger contacting relation with said high friction surfaces in any operating position of the headrest, the blocks themselves also providing low friction surfaces against which the bar may ride when the headrest is being repositioned by initially pushing it to a more vertical position.

10 Claims, 4 Drawing Figures

DENTAL CHAIR HEADREST LOCKING DEVICE

CROSS-REFERENCE TO OTHER RELATED APPLICATIONS

Reference is hereby made to copending patent application Ser. No. 809,579, filed June 24, 1977, for "Dental Chair Headrest Locking Device" of Robert C. Jaeger, assigned to the same assignee hereof.

STATEMENT OF THE INVENTION

This invention relates to a dental chair and more particularly concerns improved means for positively locking and releasing the headrest thereof at a desired height or position.

BACKGROUND OF THE INVENTION

It is essential that the headrest, once adjusted to the proper position by the dentist, remain positively locked in that position while the patient is being treated. Prior art headrest locking devices, in order to achieve an equivalent degree of positive locking, required critical and/or time-consuming adjustments, or employed metal to metal contact of moving parts which were unnecessarily noisy.

Accordingly, it is an object of the present invention to provide a positive means for locking a dental headrest in position.

Another object of the invention is to provide such locking means which can be instantly unlocked, repositioned and returned again to a locked position.

Still another object of the invention is to provide such positive locking means which are inexpensive, easy to manufacture, and very rapidly and quietly adjustable.

A still further object of the invention is to provide such means which are devoid of metal to metal contact of moving parts.

Other objects and a fuller understanding of the invention may be had by referring to the following description and claims taken in conjunction with the accompanying drawings.

DETAILED DESCRIPTION OF THE INVENTION

Figure 1:
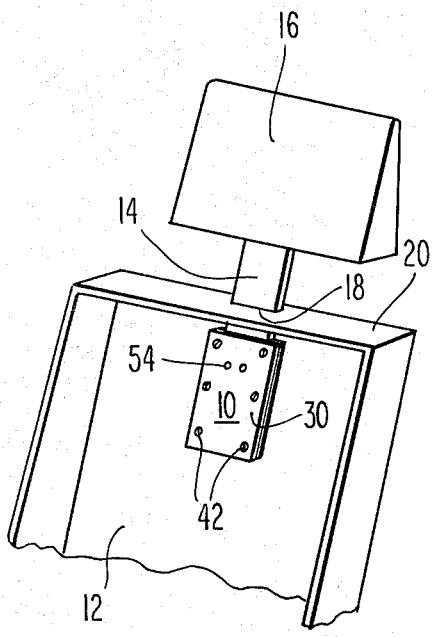
FIG. 1 illustrates the headrest locking device affixed to the back of a dental chair.

Referring to the drawings and more particularly to FIG. 1 thereof, there is shown an improved positive headrest locking device 10 affixed to the backrest 12 of a dental chair. An elongated headrest bar 14 extends from headrest 16 and passes through a longitudinal slot 18 disposed centrally in an upper portion 20 of the chair backrest. By means of the bar 14 cooperating with locking device 10, the headrest may readily be positioned with respect to the chair backrest and positively locked at that position through the simple expediency of permitting the weight of the headrest itself to provide the necessary force to initiate the positive locking action, to be described more fully hereinafter.

Figure 2:
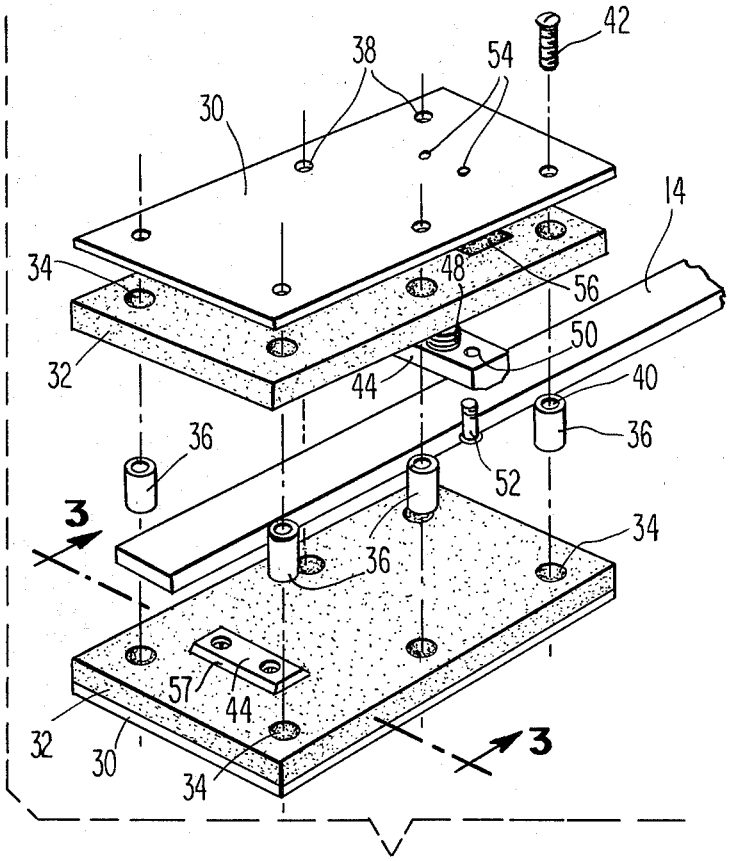
FIG. 2 is an exploded view of the locking device including the headrest bar operably engaged therein for adjustable movement therethrough.

Referring now to FIG. 2, the locking device 10 comprises a pair of rigid or metallic plates 30, suitably of steel or aluminum, each having a rubber, or rubberlike pad 32 of high friction material adhered to its inner faces by any type suitable cement, for example. A plurality of uniformly spaced holes 34 are provided in the rubber pads 32, each such hole snugly receiving a spacer 36 made of nylon or polytetrafluoroethylene or similar low friction material. Metal plates 30 are similarly provided with holes 38, aligned with holes 34, but of a smaller diameter. It is preferred that the rubber pads 32 have a durometer reading of between about 15 to 25.

Each spacer 36 is provided with a central orifice 40 for receiving a screw 42 therethrough for mounting the entire locking device to the dental chair backrest 12. The spacers 36 will have a length which, when assembled into the locking device, will present an exposed area slightly greater than the thickness of the headrest bar 14 such that the headrest bar may move longitudinally of the locking device without contacting the rubber pads 32. Thus, as shown in FIG. 2, the spacers 36 are not disposed in contacting relation with the headrest bar but are sufficiently close to the path of longitudinal movement of the headrest bar 14 to prevent its side to side, or lateral motion when the headrest 16 is being repositioned.

Figure 4:
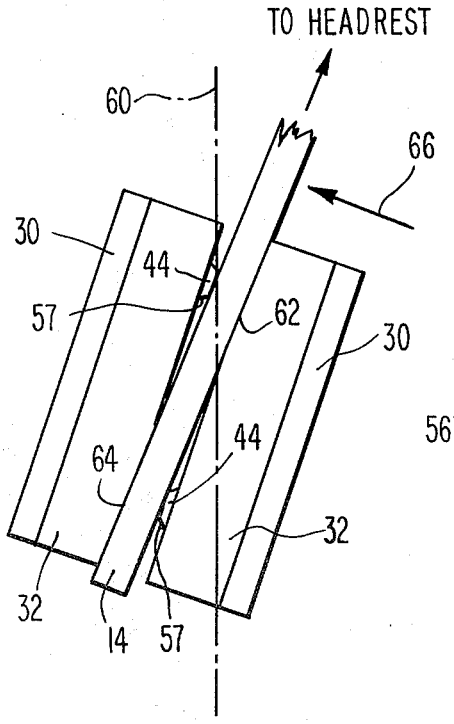
FIG. 4 is a side view of the locking device shown in FIG. 1.
Figure 3:
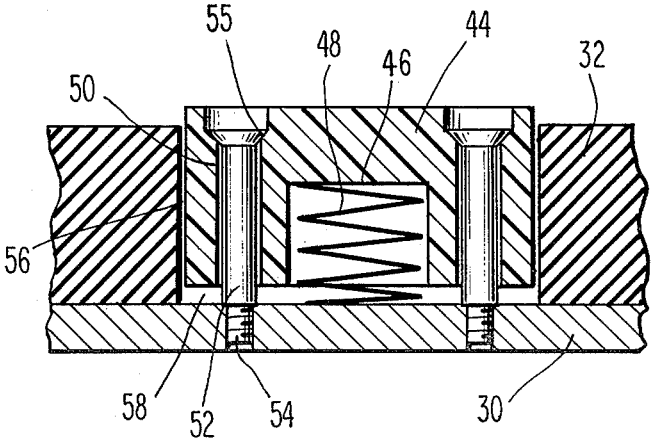
FIG. 3 is a sectional view of my locking device taken along line 3—3 of FIG. 2.

The metallic plates 30 provide rigidity to the device 10 and means for adequately supporting the mounting screws 42 as well as a pair of spring-loaded blocks 44, of nylon, polytetraflurorethylene, or other low-friction material. Blocks 44 are provided with a central cavity 46 (FIG. 3) for receiving a compression spring 48, and are also provided with a pair of bores 50, enabling screws 52 to pass therethrough for threaded engagement in the metallic plates 30 at 54. Bores 50 are counter-sunk at 55. Blocks 44 are received within cut-out portions 56 of rubber pads 32 and extend beyond the pads 32 and are in constant contact with the headrest bar 14. Since the blocks 44 comprise a low friction material, they readily facilitate the sliding motion of the bar when it is desired to reposition the headrest. In order to promote sliding movement between the headrest bar 14 and spring-loaded blocks 44, the latter may be beveled at 57 as shown in FIGS. 2 and 4. It should be apparent that blocks 44 are subjected to compressive forces when in contact with the moving headrest bar 14, and spaces 58 are thus provided between plates 30 and blocks 44 into which each block may be partially or wholly displaced when so compressed.

Reference will now be made to FIG. 4 of the drawings wherein the locking device 10 is shown disposed at any angle away from the vertical, indicated by a broken line identified with the numeral 60. Since the chair backrest 12 and headrest 16 will never be in a perpendicular operating position, the weight of the headrest alone will usually provide enough force for the bar 14 to engage the rubber pads 32 at areas designated generally at 62 and 64. Of course, with a patient's head on the headrest 16, an even greater force is exerted at contact areas 62 and 64, thus providing an even more positive locking arrangement. The blocks 44 are not disposed in opposing face-to-face relation, but in opposed staggered relation to produce a coupling effect as shown in the drawing. Thus, by merely pushing the headrest 16 in the direction of arrow 66, it will be apparent that the contacting surfaces between the bar 14 and rubber pads 32 will be substantially eliminated. Simultaneously, the bar 14, in constant spring-urged contact with the blocks 44, will cause the blocks to be depressed into their respective spaces 58, the blocks also providing low friction surfaces against which the headrest bar may glide along with only minimum effort. It must be borne in mind that, regardless of the position of the chair or headrest, the spring-loaded blocks 44 are designed to exert some force against the bar 14. Thus, even with the headrest 16 in a completely vertical position, the bar 14 will not slip downwardly due to the spring-loaded coupling forces bearing thereagainst. By varying spring tension, spacer height, and rubber thickness with respect to the headrest bar thickness, as well as the compressive characteristics of the rubber used, the positive locking effect of the invention can be controllably increased or decreased.

Nor is it intended that the device be limited to use on dental chairs since obvious modifications will occur to one skilled in the art to adapt the invention to other and related application.

What is claimed is:

1. A dental chair including an adjustable headrest and a locking mechanism therefore, said chair comprising a backrest having an upper member provided with a centrally disposed longitudinal slot, said headrest comprising a head support member and an elongated bar member having one end affixed to a lower central portion thereof and adapted to be received in said slot for movement therethrough, said locking mechanism being affixed interiorly to an upper central portion of said backrest, said locking mechanism engaging the other end of said bar member, said bar member being substantially rectangular in cross section and having at least a pair of opposed flat surfaces, said locking mechanism comprising:

a. a pair of rigidly supported pads in parallel relationship, said pads being made of high friction material, said pads providing a space for slidably receiving said bar member to provide high friction contact between opposed faces of said pads and said opposed flat surfaces of said bar member when said bar member contacts said pads in a non-vertical position, b. a low friction material, spring-loaded block extending through each of said pads and into said space provided by said pads, each of said blocks contacting an opposed flat surface of said bar in staggered coupling relationship when said bar is in a vertical position and non-vertical position, said blocks being substantially simultaneously compressed upon application of a force to said head support member in a direction which reduces contact between said pads and said flat surfaces of said bar member.

2. The locking mechanism in accordance with claim 1 wherein a metallic plate is cemented to an outer flat surface of each said pads to provide rigidity and support for said locking mechanism.

3. The locking mechanism in accordance with claim 2 wherein said pads of high friction material and metallic plates are provided with a plurality of holes therethrough, said holes in said pads and plates being aligned, said holes in said pads being of larger diameter than the holes of said plates, spacer means disposed into opposed holes of each of said pads, said spacer means having a diameter greater than the diameter of said holes in said plates, each of said spacer means providing a portion thereof which is exposed by virtue of said spacer means having a length in excess of combined thicknesses of said pads, said excess being slightly greater than thickness of said headrest bar member such that said headrest bar member may move longitudinally in said locking mechanism without substantial contact with said pads, said portions of said spacer means which are exposed being so arranged whereby said headrest bar member is movable longitudinally within said locking mechanism without contacting said exposed portions and yet sufficiently close to said exposed portions to provide controlled lateral movement of said bar member when said headrest member is caused to be moved towards or away from said chair backrest.

4. The locking mechanism in accordance with claim 3 wherein each of said spacer means is provided with an orifice centrally therethrough, and means for mounting said locking mechanism to said chair backrest.

5. The locking mechanism of claim 4 further characterized by said high friction pads being made of rubber having a durometer value of between about 15 to 25.

6. The locking mechanism of claim 4 further characterized by said spacers comprising a low friction material selected from the group consisting of nylon and polytetrafluoroethylene.

7. The locking mechanism of claim 4 further characterized by said mechanism being devoid of any metal to metal contact of moving parts.

8. The locking mechanism in accordance with claim 2 wherein each of said high friction material pads is provided with a cut-out portion for receiving one of said spring-loaded blocks and each of said blocks is mounted to one of said metallic plates.

9. The locking mechanism in accordance with claim 8 wherein said blocks are provided with a central cavity, spring means disposed within said cavity of each of said blocks, bore means disposed through each of said blocks for permitting mounting thereof to said metallic plates, said spring means urging said block members away from said metallic plates and into contacting relation with said opposed flat surfaces of said bar in staggered coupling relationship.

10. The locking mechanism of claim 8 wherein said blocks comprises a low friction material selected from the group consisting of nylon and polytetrafluoroethylene.

* * * * *